US009254548B2

(12) United States Patent
Chao et al.

(10) Patent No.: US 9,254,548 B2
(45) Date of Patent: Feb. 9, 2016

(54) METHOD OF FORMING DIAMOND CONDITIONERS FOR CMP PROCESS

(75) Inventors: Yen-Chang Chao, Taichung (TW); Kei-Wei Chen, Tainan (TW); Ying-Lang Wang, Lung-Jing Country (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 816 days.

(21) Appl. No.: 13/455,448

(22) Filed: Apr. 25, 2012

(65) Prior Publication Data

US 2013/0288582 A1 Oct. 31, 2013

(51) Int. Cl.

| | |
|---|---|
| ***B24B 53/017*** | (2012.01) |
| ***B24D 3/06*** | (2006.01) |
| ***B24D 3/28*** | (2006.01) |
| ***B24D 18/00*** | (2006.01) |

(52) U.S. Cl.

CPC ..... *B24B 53/017* (2013.01); *B24D 3/06* (2013.01); *B24D 3/28* (2013.01); *B24D 18/00* (2013.01)

(58) Field of Classification Search

CPC ..... B24D 3/28; B24D 3/06; B24D 18/00; B24B 53/017

See application file for complete search history.

(56) References Cited

U.S. PATENT DOCUMENTS

| | | | | |
|---|---|---|---|---|
| 5,256,170 | A * | 10/1993 | Harmer et al. | 51/293 |
| 5,496,386 | A * | 3/1996 | Broberg et al. | 51/295 |
| 5,551,961 | A * | 9/1996 | Engen et al. | 51/298 |
| 5,766,277 | A * | 6/1998 | DeVoe et al. | 51/295 |
| 5,914,299 | A * | 6/1999 | Harmer et al. | 51/298 |
| 5,922,136 | A | 7/1999 | Huang | |
| 6,217,432 | B1 * | 4/2001 | Woo | 451/534 |

(Continued)

FOREIGN PATENT DOCUMENTS

| | | |
|---|---|---|
| TW | 200510562 A | 3/2005 |
| TW | 200743551 A | 12/2007 |

(Continued)

OTHER PUBLICATIONS

Official Action issued Oct. 23, 2014, in counterpart TW patent application No. 10321477910.

(Continued)

*Primary Examiner* — Lee D Wilson
*Assistant Examiner* — Tyrone V Hall, Jr.
(74) *Attorney, Agent, or Firm* — Duane Morris LLP

(57) ABSTRACT

A method for making a conditioner disk used in a chemical mechanical polishing (CMP) process comprises applying a first layer of at least one binder over a substrate; disposing a plurality of diamond particles on the first layer of the at least one first binder at the plurality of locations; and fixing the plurality of diamond particles to the substrate by heating the substrate to a raised temperature and then cooling the substrate. The plurality of diamond particles disposed over the substrate are configured to provide a working diamond ratio higher than 50% when the conditioner disk is used in a CMP process.

20 Claims, 3 Drawing Sheets

(56) References Cited

U.S. PATENT DOCUMENTS

| | | | | |
|---|---|---|---|---|
| 6,368,198 | B1 * | 4/2002 | Sung et al. | 451/443 |
| 6,699,106 | B2 | 3/2004 | Myoung et al. | |
| 6,818,029 | B2 | 11/2004 | Myoung et al. | |
| 6,872,127 | B2 | 3/2005 | Lin et al. | |
| 7,150,677 | B2 | 12/2006 | Yamashita et al. | |
| 7,267,600 | B1 | 9/2007 | Lin et al. | |
| 2001/0025457 | A1 * | 10/2001 | Tselesin | 51/293 |
| 2002/0194790 | A1 | 12/2002 | Wang et al. | |
| 2005/0025973 | A1 * | 2/2005 | Slutz et al. | 428/408 |
| 2007/0037493 | A1 | 2/2007 | Shih | |
| 2009/0145045 | A1 * | 6/2009 | Sung | 51/307 |
| 2009/0235591 | A1 * | 9/2009 | Yener et al. | 51/308 |

FOREIGN PATENT DOCUMENTS

| | | | |
|---|---|---|---|
| TW | 201103693 | A | 2/2011 |
| TW | 201127554 | A | 8/2011 |

OTHER PUBLICATIONS

Zabasajja, J. et al., "Diamond Pad Conditioner Design and Performance in Copper CMP", 3M Electronics Markets Materials Division, St. Paul, MN., 2011, 4 pages, www.3m.com/electronics.

Pysher, D. et al., "Design, Characteristics and Performance of Diamond Pad Conditioners", Reprinted from Mater. Res. Soc. Symp. Proc., 2010 Materials Research Society, vol. 1249, 7 pages.

Olson, D.W., "Diamond, Industrial", U.S. Geological Survey Minerals Yearbook, 2001, 9 pages.

SR-LF Series Vision Dispensing Robot, Everprecision Tech Co., Ltd., SR-Series PR-4035D, 2 pages. Retrieved from: http://www.rs232.com.tw/epweb/e-srseries-vis.html.

MICRON Sized Diamond Powders, Tomei Diamond, Cedar Park, Texas, 2 pages. Retrieved from: http://www.tomeidiamond.com/p3.htm.

Official Action issued Jun. 16, 2015, in counterpart TW patent application No. 10420790400.

* cited by examiner

METHOD OF FORMING DIAMOND CONDITIONERS FOR CMP PROCESS

FIELD

The disclosure relates to conditioner disks used in chemical mechanical polishing (CMP), and the methods of manufacturing the same.

BACKGROUND

Chemical mechanical polishing/planarization (CMP) is a key process of smoothing surface of semiconductor wafers through both chemical etching and physical abrasion. A semiconductor wafer is mounted onto a polishing head, which rotates during a CMP process. The rotating polishing head presses the semiconductor wafer against a rotating polishing pad. Slurry containing chemical etchants and colloid particles is applied onto the polishing pad. Irregularities on the surface are removed to result in planarization of the semiconductor wafer.

In a CMP process, conditioner disks are used to prepare and maintain the surface of polishing pad. A conditioner disk removes the debris on the polishing pad surface and revives the polish pad surface to ensure a stable CMP process. A conditioner disk generally comprises abrasive particles fixed on a substrate. Non-uniformity of the surface of the conditioner disk can result in non-uniformity in smoothness of the resulting wafer. In addition, some abrasive particles might be dislodged and pulled out from the surface. Such dislodgement and pull-out cause further deterioration of the wafer surface uniformity.

Meanwhile, the size of semiconductor wafers has increased to improve throughput and reduce cost per die. For example, in the transition from 300 mm to 450 mm wafer size, the wafer area increases by 125%. The uniformity in smoothness of the whole wafer becomes more difficult to maintain in the more-than-doubled-sized wafer.

BRIEF DESCRIPTION OF THE DRAWINGS

The present disclosure is best understood from the following detailed description when read in conjunction with the accompanying drawings. It is emphasized that, according to common practice, the various features of the drawings are not necessarily to scale. On the contrary, the dimensions of the various features are arbitrarily expanded or reduced for clarity. Like numerals denote like features throughout specification and drawing.

DETAILED DESCRIPTION

Figure 1:
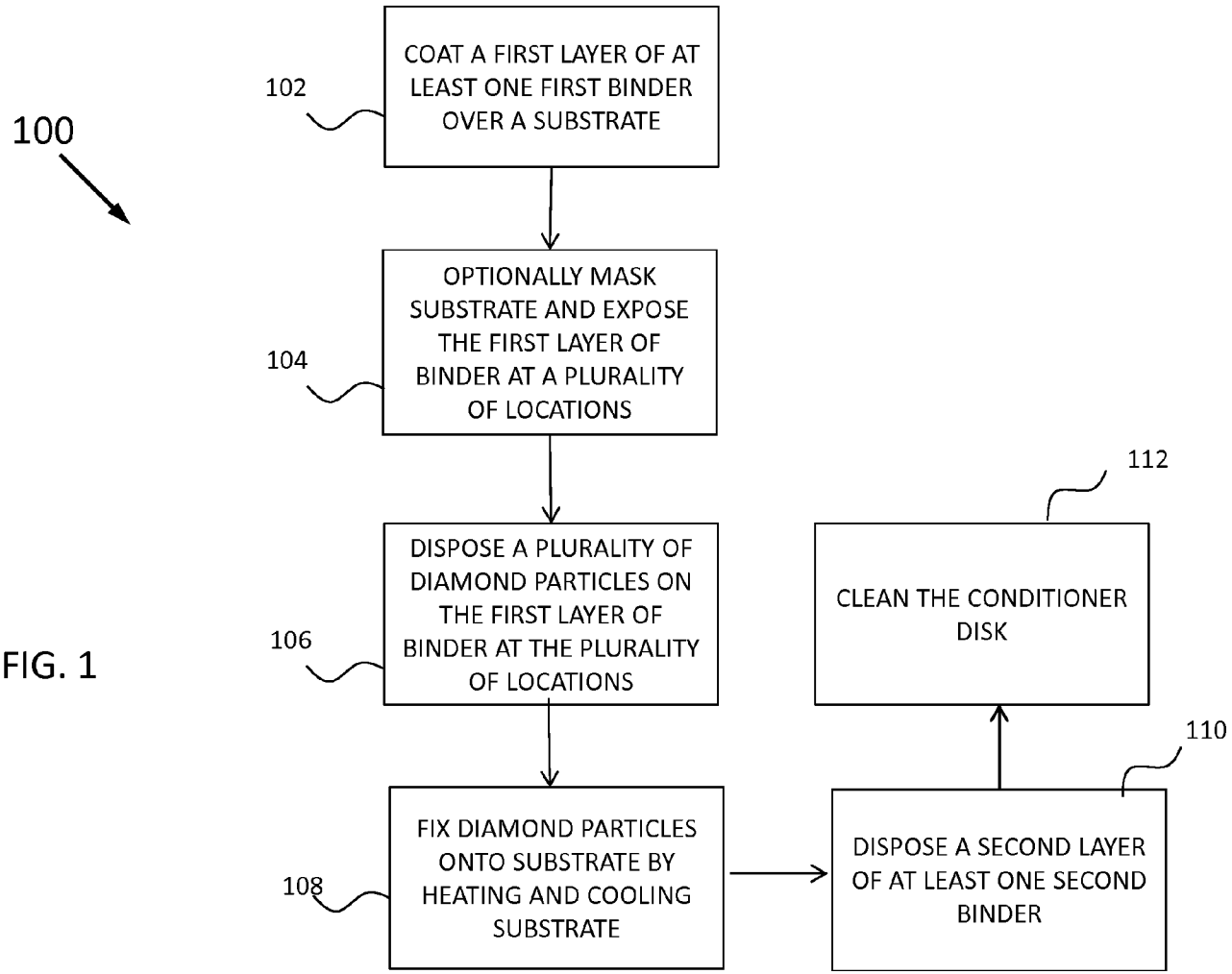
FIG. 1 is a flow chart diagram illustrating an exemplary method for making a conditioner disk used in a chemical mechanical polishing (CMP) process, in accordance with some embodiments.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

In the conventional conditioner pads or disks used in a CMP process, the abrasive particles are generally fixed onto a substrate using an electroplated metal or a brazing alloy. Dislodgement and pull-out of the abrasive particles occur due to insufficient interfacial bonding between the abrasive particles and the substrate. More particularly, not all the abrasive particles on the conditioner disk surface are available as the working abrasive particles for contacting the surface of the polishing disk. A conditioner disk having strong bonding and high ratio of the working abrasive particles are desired.

This disclosure provides a method for making a conditioner disk comprising diamond particles and the resulting conditioner disk, which is configured to provide a high working diamond ratio with good interfacial bonding during its use in a CMP process.

In some embodiments, the method comprises applying a first layer of at least one binder over a substrate; disposing a plurality of diamond particles on the first layer of the at least one first binder at a plurality of locations; and fixing the plurality of diamond particles to the substrate by heating the substrate to a raised temperature and then cooling the substrate. In some embodiments, the method further comprises disposing a second layer of at least one second binder over the substrate after disposing and fixing the plurality of the particles on the substrate.

This disclosure also provides a conditioner disk used in a chemical mechanical polishing (CMP) process. The conditioner disk comprises a substrate; a first binder layer comprising at least one binder disposed over the substrate; and a plurality of diamond particles disposed on the first binder layer at a plurality of locations. In such a conditioner disk, the plurality of diamond particles are uniformly distributed over the substrate, and the conditioner disk is configured to provide a working diamond ratio higher than 50%. In some embodiments, the working diamond ratio is higher than 75%. In some embodiments, the working diamond ration is higher than 90%.

For brevity, references to "diamond" in this disclosure will be understood to encompass any form of carbon selected from: conventional diamond as an allotrope of carbon, where the carbon atoms are arranged in a tetrahedron configuration as a variation of the face-centered cubic crystal structure; polycrystalline diamond (PCD), diamond-like carbon (DLC) having amorphous structure; and any combination or any variation of traditional diamond, polycrystalline diamond and DLC. References to "diamond particles" will be understood to encompass any diamond or DLC in any shape of a regular or irregular form, or combination thereof.

References to "working diamond" in this disclosure will be understood to encompass the diamond particles fixed to the substrate and capable of contacting a working surface such as a polishing pad. Reference to the "working diamond ratio" in this disclosure will be understood as the ratio of the working diamond particles among all the diamond particles disposed over a substrate. In some embodiments, the working diamond ratio can be measured by determining the number of all the diamond particles disposed over the substrate, and determining the number of the available working diamond particles when the conditioner disk is pressed against a working surface or a flat surface as the control. The number of the available working diamond particles divided by the number of all the diamond particles is the working diamond ratio.

FIG. 1 is a flow chart diagram 100 illustrating an exemplary method for making a conditioner disk 500 used in a chemical mechanical polishing (CMP) process, in accordance with some embodiments. FIGS. 2-5 illustrate the structure in each step of such a method.

Figure 2:
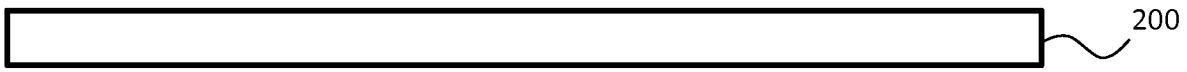
FIG. 2 is a cross section view of an exemplary substrate, in accordance with some embodiments.

FIG. 2 is a cross section view of an exemplary substrate 200 for a conditioner disk, in accordance with some embodiments. Examples of substrate 200 include but are not limited to metals, metal alloys, ceramics and organic materials such as engineering plastics. Examples of suitable materials include but are not limited to stainless steel, copper alloy, alumina, and polyether ether ketone (PEEK). In some embodiments, the substrates are optionally treated with at least one adhesion promoter. Examples of adhesion promoters include but are not limited to silane coupling agents having different functional group.

Figure 3:
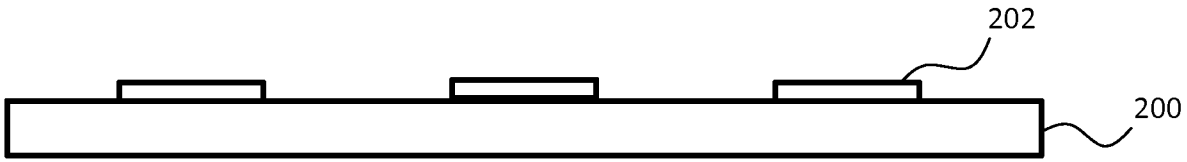
FIG. 3 illustrates a first layer of at least one first binder disposed over the exemplary substrate of FIG. 2, in accordance with some embodiments.

In step 100 of FIG. 1, a first layer of at least one first binder 202 is coated over substrate 200. FIG. 3 illustrates the structure after a first layer of at least one first binder 202 is disposed over the exemplary substrate 200, in accordance with some embodiments.

Examples of the first layer of at least one first binder 202 include but are not limited to metals, metal alloys, and thermosetting polymers. In some embodiments, the first binder layer 202 is a metal or metal alloy comprising iron, nickel, titanium and chromium. In some other embodiments, the first binder layer 202 is a material comprising a thermosetting polymer including but are not limited to a crosslinkable/curable epoxy in a liquid or paste form. In some embodiments, a combination of a metal and a thermosetting polymer such as curable epoxy is used. In some embodiments, it is a solder flux in a liquid or paste form that can be printed and coated onto substrate 200.

Examples of suitable coating process include but are not limited to casting, spin coating, dip coating, print coating, screen printing, spray coating, powder coating, electroplating and physical or chemical vapor deposition.

In some embodiments, the first layer of the least one first binder 202 does not completely cover substrate 200. For example, in some embodiments the first binder layer 202 is disposed onto substrate 200 in a regular pattern at a plurality of locations. The patterned layer of the first binder 202 can be formed through masking the substrate followed by coating a binder, or through screen printing or direct printing a binder over the substrate. In some embodiments, the first binder layer 202 of a certain pattern is formed through a process of lithography such as photolithography.

The patterned first binder layer 202 shown in FIG. 3 is for illustration purpose only. The first layer of the at least one first binder 202 is a flat portion having a top surface parallel to the substrate surface as shown in FIG. 3 in accordance with some embodiments. The surface of the first binder layer 202 is not necessarily flat. In some embodiments, the first layer of the at least one first binder 202 has a curved top surface. A portion of the patterned first binder layer 202 can be in a shape of a dot, polygon, irregular pattern or the like.

Step 104 of FIG. 1 is an optional step. In some embodiments in which the first binder layer 202 completely cover the surface of the substrate 200, in step 104, some portions of the substrate 200 comprising the first layer of the at least one binder 202 may be masked so that portions of the first layer of the at least one binder 202 is exposed at a plurality of locations. The exposed portions of the first binder layer 202 are the locations where a plurality of diamond particles are disposed.

In step 106 of FIG. 1, a plurality of diamond particles 204 are disposed onto the first layer of binder 202 at the plurality of locations. In some embodiments, a plurality of diamond particles are disposed separately on the first layer of the at least one first binder 202 at a plurality of locations.

Figure 4:
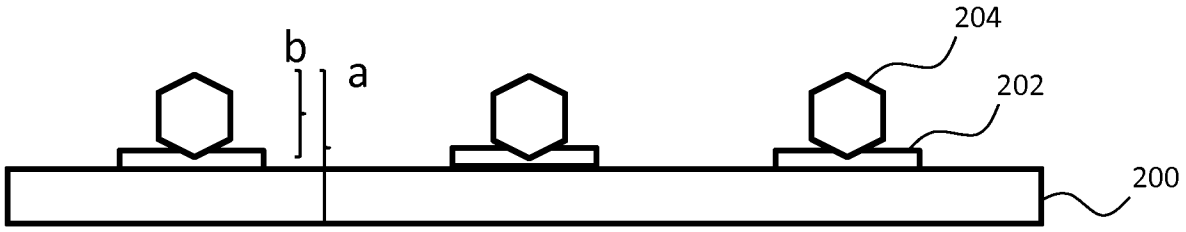
FIG. 4 is a cross section view of an exemplary resulting restructure after a plurality of diamond particles are disposed at a plurality of locations on the first layer of binder of FIG. 3, in accordance with some embodiments.

FIG. 4 is a cross section view of an exemplary resulting restructure after a plurality of diamond particles 204 disposed on the first layer of binder 202 of FIG. 3 at the plurality of locations, in accordance with some embodiments.

Examples of the diamond particles 204 include but are not limited to conventional crystalline diamond, polycrystalline diamond (PCD), diamond-like carbon (DLC) having amorphous structure; and any combination or any variation of crystalline diamond, polycrystalline diamond and DLC. In some embodiments, the diamond particles are synthetic. The diamond particles or powders can be synthesized using a process such as high-pressure high-temperature synthesis, a chemical vapor deposition and ultrasound cavitation. Examples of the suppliers of diamond particles include but are not limited to Tomei Diamond of Japan; General Electrical Super-abrasives of U.S.; Beta Diamond Products, Inc. of U.S.

In some embodiments, the diamond particles 204 are of various shapes and sizes. In some embodiments, the diamond particles are of substantially the same particle size and/or substantially the same shape. In some embodiments, the diamond particles are oriented in substantially the same direction as each other.

In some embodiments, the diamond particles have identical shape and particle size. In some embodiments, the particle size is in the range of from 0.5 to 500 microns. In some embodiments, the particle size of the diamond particles 204 are in the range of 50-300 microns. In some embodiments, all the diamond particles of the same shape and size are oriented in the same direction.

A plurality of diamond particles 204 can be disposed separately onto the first layer of binder 202 at the plurality of locations using any suitable technique. For example, in some embodiments, each diamond particle 204 is picked and then placed onto a respective patterned portion of the first layer of binder 202 by a dispense robot. An example of such a dispense robot is available from Everprecision Tech Co., Ltd. of Taiwan, under the trade name of SR-LF Series Vision Dispense Robot.

In step 108, the plurality of diamond particles 204 are fixed onto substrate 200 through the first layer of binder 202. One exemplary process is to heat substrate 200 comprising the diamond particles 204 and the first layer of binder 202 to a raised temperature, followed by a cooling step. At such a raised temperature, the first layer of the at least one first binder 202 melts in some embodiments. In some other embodiments, the first layer of the at least one first binder 202 comprising a thermosetting polymer cures to chemically form a crosslinked structure.

The heating temperature is lower than the melting point of the substrate 200. For example, in some embodiments it is less than 1500° C. when substrate 200 is stainless steel. In some other embodiments, it may be less than 800° C. when substrate 200 is a type of copper alloy. Suitable temperature range depends on material type of the first layer of binder 202 used. For example, the heating temperature is about 170° C. when a lead alloy is used in some embodiments. The heating temperature can be as high as 370° C. when a tin alloy is used in some other embodiments. The suitable temperature range is 50-150° C. when the first binder layer 202 is epoxy in some other embodiments.

During the heating and cooling process in step 108, in some embodiments, an additional step is optionally included to adjust the distribution of the plurality of the diamond particles to ensure that they are at substantially the same height and the same orientation. As shown in FIG. 4, the dimension (a) from the top of a diamond particle to the bottom surface of the substrate is substantially the same for the plurality of the diamond particles in some embodiments. The dimension of the diamond particles (b) is also substantially the same for the plurality of the diamond particles. A mold is optionally included to fix the plurality of diamond particles before the cooling procedure is finished.

Figure 5:
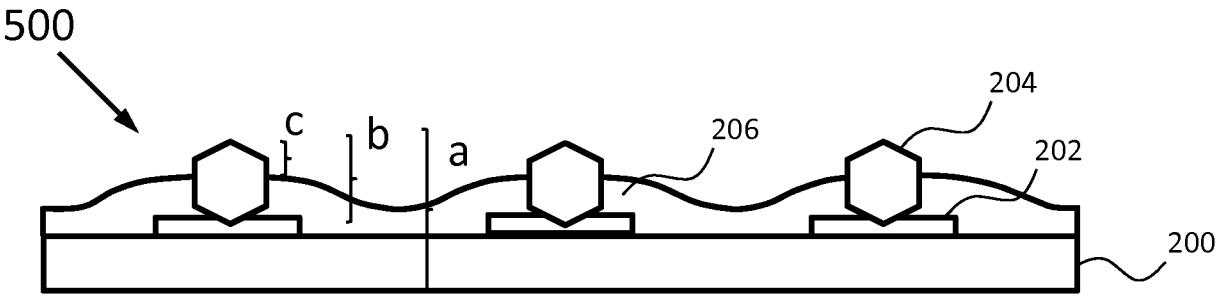
FIG. 5 illustrates an exemplary resulting structure after a second layer of at least one second binder is disposed over the resulting structure of FIG. 4, in accordance with some embodiments.

In step 110 of FIG. 1, a second layer of at least one second binder 206 is disposed over the resulting structure of FIG. 4. FIG. 5 illustrates an exemplary resulting structure 500 after step 110, in accordance with some embodiments.

Examples of the second layer of at least one second binder 206 include but are not limited to metals, metal alloys, and thermosetting polymers. In some embodiments, it is a metal or metal alloy comprising iron, nickel, titanium and chromium. In some other embodiments, the second layer of the at least second binder 206 comprises a thermosetting polymer including but are not limited to a crosslinkable/curable epoxy in a liquid or paste form. In some embodiments, a combination of a metal and a thermosetting polymer such as curable epoxy is used. If the second layer of the as least one second binder comprises a thermosetting polymer, a curing step through a mechanism such as thermal or radiation curing can be used.

Examples of suitable coating processes include but are not limited to casting, spin coating, dip coating, print coating, screen printing, spray coating, powder coating, electroplating and physical or chemical vapor deposition.

In some embodiments, the second layer of at least one second binder 206 has a chemical composition different from the first layer of the at least one first binder 202. In some embodiments, the second layer of at least one second binder 206 is chemically the same as the first layer of the at least one first binder 202.

In some embodiments, step 110 is performed before step 108 so that the second binder layer is heated or cured concurrently, while the first binder layer is heated. Therefore, only one step of curing is used. For example, if the two binder layers 202 and 206 are both heat-curable, only one step of heating followed by cooling is used in some embodiments. In some embodiments, during such a heating and cooling process, it is optional to include adjusting the distribution of the plurality of the diamond particles to ensure that they are at the same height and the same orientation. A mold is optionally included to fix the plurality of diamond particles before the cooling procedure is finished.

Step 112 of FIG. 1 is an optional step of cleaning the conditioner disk 500 after fixing the plurality of the diamond particles over the substrate. For example, the conditioner disk 500 is cleaned using solvents in some embodiments.

In FIG. 5, the exemplary conditioner disk 500 resulting from process 100 comprises substrate 200; the first layer comprising at least one first binder 202 that is coated over substrate 200; and a plurality of diamond particles 204 disposed on the first binder layer 202 at a plurality of locations. In conditioner disk 500 in accordance with some embodiments, the plurality of diamond particles 204 is uniformly distributed over the substrate 200. Conditioner disk 500 is configured to provide a working diamond ratio higher than 50%. In some embodiments, the working diamond ratio is higher than 75%. In some embodiments, the working diamond ration is higher than 90%.

In some embodiments, the plurality of diamond particles 204 at the plurality of locations shares substantially the same particle size and shape. In some embodiments, the diamond particles 204 are oriented at the same direction.

In some embodiments, the first binder layer 202 does not fully cover substrate 200. In some embodiments, the second layer of the at least one second binder 206 is disposed over substrate 200 to fully cover the top surface except the top portions of the plurality of the diamond particles 204. In some embodiments, at least 50% of the height of each diamond particle protrudes from the surface of conditioner disk 500. The ratio of dimension (c) to the dimension (b) as shown in FIG. 5, is higher than 50%. In some embodiments, at least 25% of the height of each diamond particle protrudes from the surface of conditioner disk 500. The ratio of dimension (c) to the dimension (b) is higher than 25%.

Conditioner disk 500 also provides strong adhesion between the plurality of the diamond particles 204 and substrate 200 through the two binder layers 202 and 206. It is suitable for conditioning the polishing pad in a CMP process.

This disclosure provides a method for making a conditioner disk used in a chemical mechanical polishing (CMP) process and the resulting conditioner disk.

In some embodiments, the method comprises applying a first layer of at least one binder over a substrate; disposing a plurality of diamond particles on the first layer of the at least one first binder at a plurality of locations; and fixing the plurality of diamond particles to the substrate by heating the substrate to a raised temperature and then cooling the substrate. In such a process, the plurality of diamond particles are uniformly disposed over the substrate, and are configured to provide a working diamond ratio higher than 50% when the conditioner disk is used in a CMP process. In some embodiments, the plurality of the diamond particles is of substantially the same particle size. In some embodiments, the method further comprises masking the substrate after applying the first layer of the at least one first binder at a plurality of locations onto the substrate so that a plurality of portions of the first binder layer are exposed for disposing a plurality of diamond particles. In some embodiments, a plurality of diamond particles are disposed separately onto the first layer of the at least one first binder at a plurality of locations. Each diamond particle is individually placed onto one portion of the first binder layer.

In some embodiments, the method further comprises disposing a second layer of at least one second binder over the substrate after disposing and fixing the plurality of the particles on the substrate. In some embodiments, the second layer of at least one second binder is the same as the at least one first binder. In some embodiments, the second layer of at least one second binder is different from the at least one first binder. The at least one first binder or the at least second binder is a metal, a metal alloy or a thermosetting polymer resin. In some embodiments, the second layer of the at least one second binder is disposed over the substrate to fully cover the top surface except the top portions of the plurality of the diamond particles.

This disclosure also provides a method for making a conditioner disk used in a chemical mechanical polishing (CMP) process. The method comprises coating a first layer of at least one binder over a substrate at a plurality of locations, the first layer of at least one binder does not completely cover the substrate. The method further comprises disposing a plurality of diamond particles separately on the first layer of the at least one first binder at the plurality of locations; and fixing the plurality of diamond particles to the substrate by heating the substrate to a raised temperature and then cooling the substrate. In such a process, the plurality of diamond particles are uniformly disposed over the substrate, and are configured to provide a working diamond ratio higher than 50% when the conditioner disk is used in a CMP process.

In some embodiments, a conditioner disk used in a chemical mechanical process (CMP) comprises a substrate; a first binder layer comprising at least one binder disposed over the substrate; and a plurality of diamond particles disposed on the first binder layer at a plurality of locations. In such a conditioner disk, the plurality of diamond particles are uniformly distributed over the substrate, and the conditioner disk is configured to provide a working diamond ratio higher than 50%. In some embodiments, the diamond particles are of substantially the same particle size. In some embodiments, the diamond particles are oriented in substantially the same direction as each other.

Although the subject matter has been described in terms of exemplary embodiments, it is not limited thereto. Rather, the appended claims should be construed broadly, to include other variants and embodiments, which may be made by those skilled in the art.

What is claimed is:

1. A method for making a conditioner disk used in a chemical mechanical polishing (CMP) process, comprising:

applying a first layer of at least one binder over a substrate;

disposing a plurality of diamond particles on the first layer of the at least one first binder at a plurality of locations;

fixing the plurality of diamond particles to the substrate by heating the substrate to a raised temperature and then cooling the substrate; and coating a second layer of at least one second binder over the substrate, wherein at least one top portion of each of the plurality of diamond particles protrudes out of the second layer of at least one second binder and is exposed, and the plurality of diamond particles disposed over the substrate are configured to provide a working diamond ratio higher than 50% when the conditioner disk contacts a flat surface.

2. The method of claim 1, wherein a material of the at least one second binder is the same as the at least one first binder.

3. The method of claim 1, wherein the second binder layer is heated concurrently while the first binder layer is heated.

4. The method of claim 1, wherein the first binder layer and the second binder layer are coated through a process selecting from the group consisting of spin coating, dip coating, screen printing, spraying coating and electroplating.

5. The method of claim 1, further comprising controlling distribution of the plurality of diamond particles during the steps of heating and cooling the substrate.

6. The method of claim 1, wherein the at least one first binder is a metal or metal alloy.

7. The method of claim 6, wherein the one first binder comprises a metal selected from a group consisting of nickel, titanium, iron and chromium.

8. The method of claim 1, wherein the at least one first binder is a material comprising a thermosetting polymer which is formed through curing a cross-linkable polymer in a liquid or paste form.

9. The method of claim 1, wherein the plurality of the diamond particles are of substantially the same particle size as each other.

10. The method of claim 1, wherein the plurality of the diamond particles are oriented in substantially the same direction as each other.

11. The method of claim 1 further comprising masking the substrate after applying the first layer of the at least one first binder at a plurality of locations over the substrate, the first layer of the at least one binder is configured to provide a plurality of exposed portions at the plurality of locations for disposing a plurality of diamond particles.

12. The method of claim 1, wherein the first layer of at least one binder is disposed over the substrate in a regular pattern at the plurality of the locations.

13. The method of claim 1, wherein the step of disposing the plurality of diamond particles on the first layer of the at least one first binder layer comprises picking a respective diamond particle and placing the respective diamond particle onto a respective portion of the first layer of at least one binder by a robot.

14. The method of claim 1, wherein the plurality of diamond particles have a particle size in the range of from 0.5 micron to 500 microns.

15. The method of claim 1, wherein the working diamond ratio is higher than 75%.

16. The method of claim 1, wherein the working diamond ratio is higher than 90%.

17. A method for making a conditioner disk used in a chemical mechanical polishing (CMP) process, comprising:

applying a first layer of at least one binder over a substrate at a plurality of locations, such that the first layer of at least one binder does not completely cover the substrate;

disposing a plurality of diamond particles on the first layer of the at least one first binder at the plurality of locations;

fixing the plurality of diamond particles to the substrate by heating the substrate to a raised temperature and then cooling the substrate, and coating a second layer of at least one second binder over the substrate, wherein at least one top portion of each of the plurality of diamond particles protrudes out of the second layer of at least one second binder and is exposed, and the plurality of diamond particles disposed over the substrate are configured to provide a working diamond ratio higher than 50% when the conditioner disk contacts a flat surface.

18. A method for making a conditioner disk used in a chemical mechanical polishing (CMP) process, comprising:

applying a first layer of at least one binder over a substrate;

masking the substrate to expose the first layer of at least one binder at a plurality of locations;

disposing a plurality of diamond particles on the first layer of the at least one first binder at the plurality of locations;

fixing the plurality of diamond particles to the substrate by heating the substrate to a raised temperature and then cooling the substrate, and coating a second layer of at least one second binder over the substrate after the step of fixing the plurality of diamond particles, wherein at least one top portion of each of the plurality of diamond particles protrudes out of the second layer of at least one second binder and is exposed, and the plurality of diamond particles disposed over the substrate are configured to provide a working diamond ratio higher than 50% when the conditioner disk contacts a flat surface.

19. The method of claim 18, wherein the first layer of at least one binder completely covers a surface of the substrate.

20. The method of claim 18, wherein the step of disposing the plurality of diamond particles on the first layer of the at least one first binder layer comprises picking a respective diamond particle and placing the respective diamond particle onto a respective location of the plurality of locations by a robot.

* * * * *